United States Patent [19]

Wolford, Jr. et al.

[11] Patent Number: 4,694,869

[45] Date of Patent: Sep. 22, 1987

[54] TOOL FOR WRAPPING DROP WIRES FOR SUSPENDED GRID CEILING

[76] Inventors: Otis Wolford, Jr., 1105 N. Meadow La., Mt. Prospect, Ill. 60056; Richard P. Wolford, 55 Payson Ct., Hoffman Estates, Ill. 60194

[21] Appl. No.: 862,469

[22] Filed: May 12, 1986

[51] Int. Cl.[4] ..... B21F 7/00

[52] U.S. Cl. ..... 140/119; 140/118

[58] Field of Search ..... 140/102.5, 115, 117, 140/118, 119; D29/105; 248/188.5

[56] References Cited

U.S. PATENT DOCUMENTS

| | | | |
|---|---|---|---|
| 489,020 | 1/1893 | Lehmann | D29/105 |
| 561,143 | 6/1896 | Tinsley | 140/117 |
| 632,324 | 9/1899 | Pottenger | 140/117 |
| 1,014,498 | 1/1912 | Long | 140/122 |
| 1,014,554 | 1/1912 | Zent | 248/188.5 |
| 3,030,984 | 4/1962 | Vogt et al. | 140/119 |
| 3,076,263 | 2/1963 | Musto | 16/115 |
| 4,413,660 | 11/1983 | Conrad | 140/119 |

*Primary Examiner*—Frederick R. Schmidt
*Assistant Examiner*—Robert Showalter
*Attorney, Agent, or Firm*—Charles F. Lind

[57] ABSTRACT

The disclosed tool has a head forming a sleeve, a wall extended upwardly beyond the sleeve along one side thereof, and a finger projected off the wall laterally of the sleeve. A slot is extended downwardly from the upper edge of the wall, generally overlying and open to the sleeve. The sleeve interior is sized to receive simultaneously the tension sections of a number of hanger wires; while the slot is sized widthwise to receive the bend section of only one hanger wire. However, the slot lengthwise is several times the slot width, which serves to keep the wire from wobbling when carried in the slot, with its wrap section then projected away from the tool and finger, to allow it to be hooked over an overlying support structure. The sleeve has a sloped upper edge, spaced below the upper wall slot, and sloping downwardly away from the wall, which serves to bunch together the many hanger wires carried in the sleeve, and provide that their wrap sections generally project away from the wrap section of the one hanger wire carries in the slot. The sloped sleeve edge may line up with a lower finger edge, and an extendable tubular pole may be secured to the sleeve, allowing operation of the tool from a remote location.

18 Claims, 8 Drawing Figures

32
30
10
12
16
54
3
34
52
38
72
4
48
40
84
70
12a
50
36
76
78
82
30
14
46
44
18
28
56
18a
2
22
20
10
28
18
80

TOOL FOR WRAPPING DROP WIRES FOR SUSPENDED GRID CEILING

FIELD OF THE INVENTION

This invention relates to a tool for securing hanger or drop wires, used to suspend a grid framework of a suspended ceiling from overlying support members, to the support members, and more particularly, to a tool that can be operated by a user located some distance from the support members, such as while merely standing on the underlying floor and without using a ladder, scaffold or the like.

BACKGROUND OF THE INVENTION

Suspended ceilings commonly have many elongated tracks clipped together to define an open grid framework (typically defining 2 feet square openings, or defining 2 by 4 feet rectanglar openings, or defining openings as required in size and shape), with a ceiling panel supported by the framework tracks in each opening. The grid framework is generally suspended by hanger or drop wires, secured between the tracks and some overlying support structure, that in present commerical or industrial construction particularly, may consists of a network of truss or other support members.

The hanger wires are generally prebent and looped over an individual support member, thereby having two adjacent sections on opposite sides of the member and lying almost parallel to one another. One wire section, the tension section, extends to where the ceiling grid is to be located, and the other wire section, the wrap section, typically is shorter adapted to be wrapped several times around the tension section to secure the wire to the support member.

As the hanger wire is somewhat flexible, excessive strength or muscular effort is generally not needed for wrapping the wire to form the connection. However, as the network of truss or other support members may be located possibly between 10 and 20 feet above the floor, convenient access to the support member is more important. Every use of a ladder or scaffold, needed for someone to stand on in order to reach and wrap the wire, adds costs; in the ladder or scaffold itself, and in the time for setting up, moving and/or tearing down the ladder or scaffold.

Existing tools allow someone, while standing on the floor, to wrap the wire from a distance of perhaps up to 10 or 15 feet. Some tools however, provide little support for the wire, as one is attempting to hook the wire over the support member, to make this task by itself time consuming and difficult. Some tools moreover end up winding both the wrap and tension sections of the wire, entwinding the tension section around the tool to make disengagement of the tool from the wrapped wire quite difficult. Some tools only hold the one wire that is being wrapped, to require that the tool user must repeatedly bend over to pick up the next wire, after every wire has been secured. As a commerical tradesman may be expected to wrap or "drop" several hundred wires in the course of a work day, this excessive bending is very tiring and yet nonproductive.

SUMMARY OF THE INVENTION

A basic object of the present invention is to provide a tool that allows someone to secure hanger wires to an overhead elongated support member, from a distance much beyond the normal reach of the tool user without the tool, such as to support members perhaps up to even 20 feet above the floor, while yet merely standing on the floor.

More detailed objects of the invention are to provide a tool that specifically: supports the wire stably during the time when the wire is being hooked over the support member, to speed up and ease this task; wraps the wire without entwining the tension section of the wrapped wire around the tool, to allow easy and rapid disengagement of the tool from the wrapped wire; and holds many wires at the same time, to eliminate the need for picking up each wire individually, after a previous wire has been secured.

To achieve these and other objects, the present invention may provide a tool for securing a hanger wire, having generally spaced tension and wrap sections connected together across a bend, to an overhead support member, with the two sections then being on opposite sides of the support member and the wrap section extended below the support member. The tool may have an elongated tubular pole, to allow remote actuation. The tool may also have a wall extending axially upward beyond one end of the pole, along one side thereof, with a finger supported off the wall and projecting laterally of the pole. The finger may have an upper edge disposed above the end of the pole, and a slot may be extended downwardly from the upper edge generally overlying and being open to the tubular pole, and being sized to loosely receive the hanger wire therein.

The upper end of the pole may define an edge sloping downwardly away from the upstanding side wall and at a slight angle relative to being normal to the pole. This sloping edge may generally line up with the lower edge of the finger.

The upper edge of the finger may be disposed substantially normal to the pole.

The slot may be generally aligned diametrically with the tubular pole, and means on the finger, in the region of the slot, may provide a slot length several times the slot width to prevent wire rotation or wobble while carried on the tool. The slot may extends downwardly from the upper finger edge a distance between $\frac{3}{8}$ and $\frac{3}{4}$ of an inch.

The tool may further include a magnet carried on the finger proximate the slot, operable to magnetically attract and stabilize a hanger wire positioned in the slot.

The finger may be somewhat curved, having a generally straight first portion extended tangentially of the pole, and a second portion extended off of the end of the first portion remote from the pole, and being angled slightly therefrom in the direction toward the center of the tubular pole; and possibly even a third portion extended off of the second portion and angled slightly therefrom in the direction toward the center of the tubular pole, and being substantially normal to the center of the pole.

The tool may include a head having a cylindrical sleeve adapted to fit over the upper end of the pole, with means to hold the head onto the pole. The finger, upstanding side wall and slot, and the sloping edge each may thus be formed on the head. The upper edges of the finger and the sleeve may be separated by between $\frac{3}{4}$ of an inch and $1\frac{1}{2}$ inches;

The pole may be formed of telescoping tubular members, and the members may be secured together, for adjusting the length of the pole, by having a series of equally spaced holes disposed along the lengths of the members, with at least two screw means being fitted through the holes in the outer member and threaded into the holes in the inner member; and wings may be formed on the screws to allow sufficient finger tightening of the screws.

The finger may be formed of telescoping components, with means for securing the components together at adjustable setting to adjust the length of the finger and its lateral projection away from the pole.

The upper corner edge of the finger, remotely of the projection of the finger away from the pole, may be tapered from the narrowest at the upper finger edge to wider below the upper finger edge.

BRIEF DISCRIPTION OF THE DRAWINGS

Further objects and advantages of the present invention will appear from the following disclosure and description, including as a part thereof the accompanying drawings, in which.

Figures 1, 2, 3, 4:
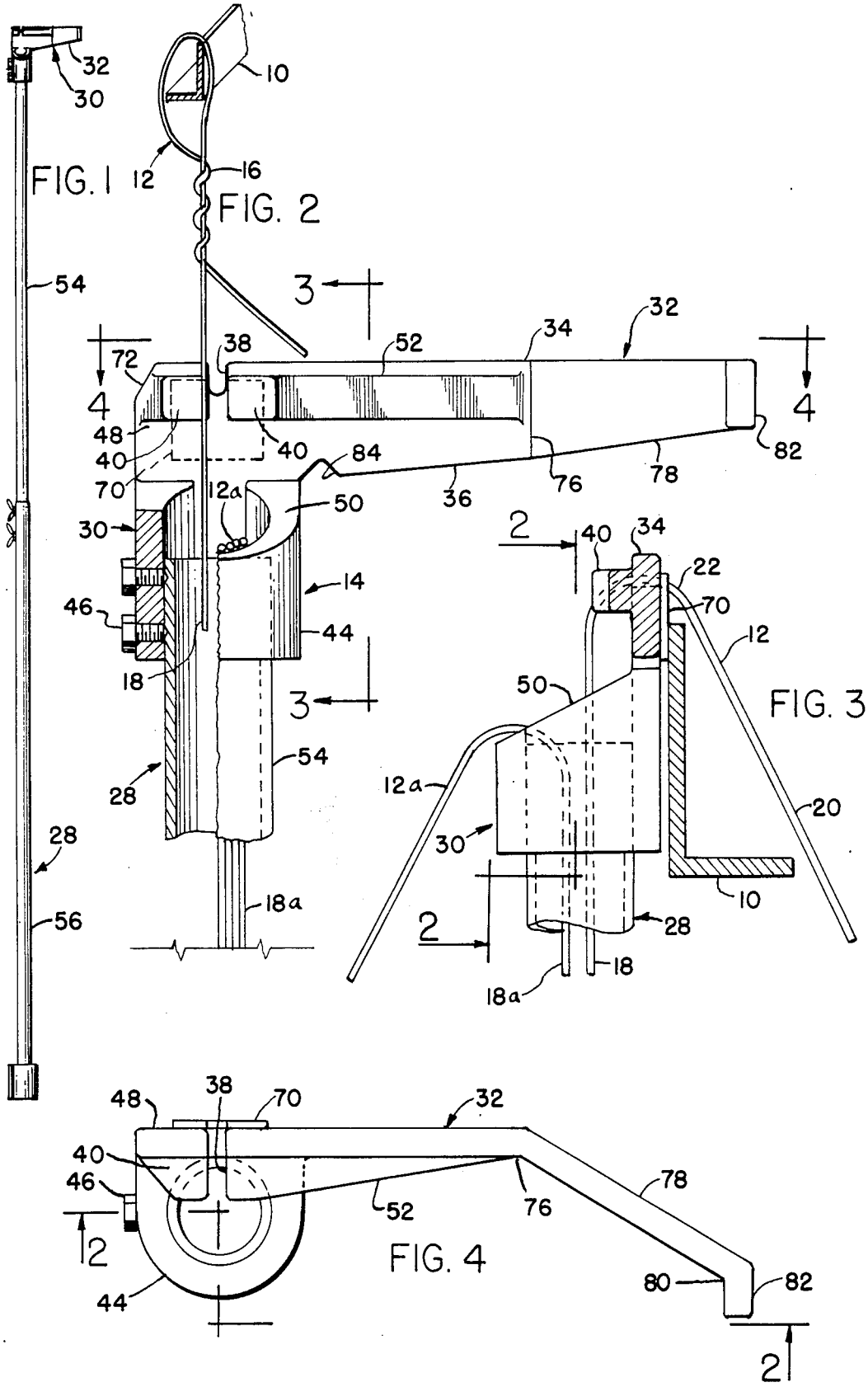
FIG. 1 is a perspective view of the basic tool forming the subject matter of this invention.
FIG. 2 is a sectional view of a typical overhead support, showing a hanger wire after it has just been wrapped thereon, with a first embodiment of the tool to be described (shown also in section as each half side of the tool sleeve might be seen from the shifted line 2—2 in FIGS. 3 and 4), being moved from the wrapped area downwardly along the tension section of the wire.
FIG. 3 is a sectional view as seen (relative to the tool) generally from line 3—3 in FIG. 2, except having the tool rotated a quarter turn and showing the hanger wire carried in the tool as it may be hooked over the support member.
FIG. 4 is a top plan view as seen generally from line 4—4 in FIG. 2, except without the hanger wires.
Figure 5:
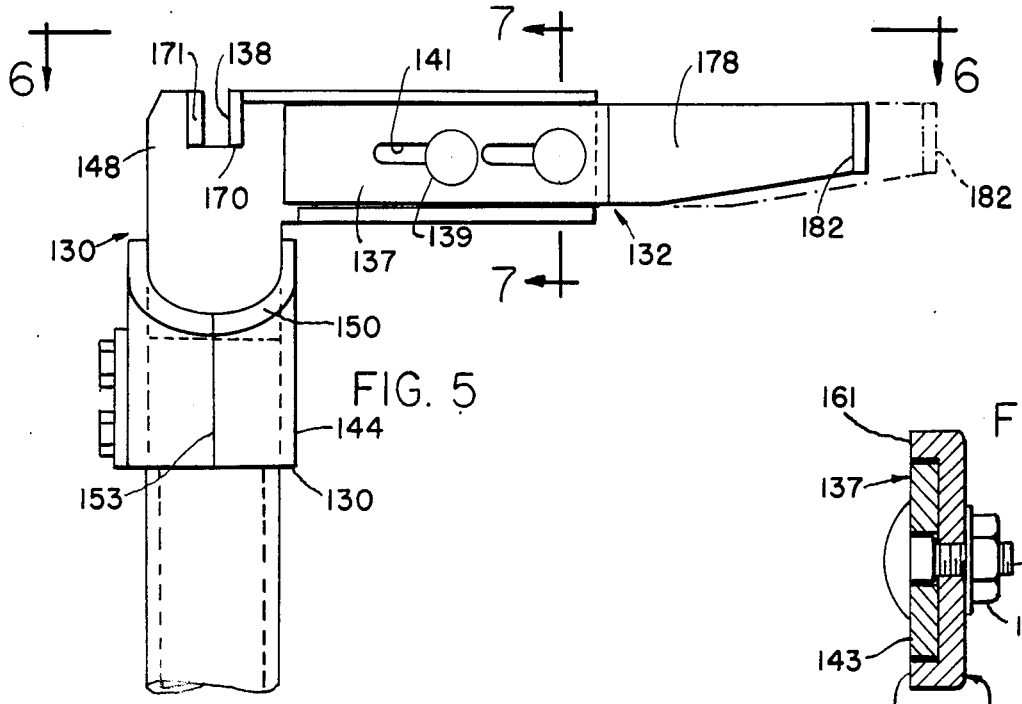
FIG. 5 is an elevational view of a second embodiment of the tool, being illustrated somewhat as FIG. 2, except without the support member and hanger wires illustrated.
Figure 7:
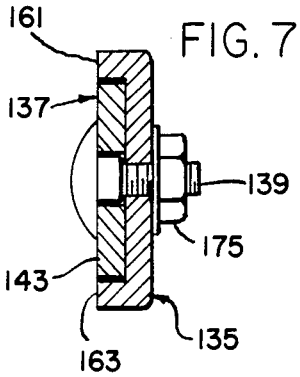
Figure 6:
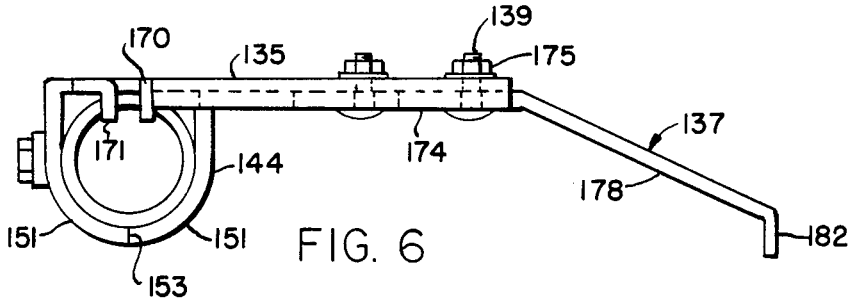
Figure 8:
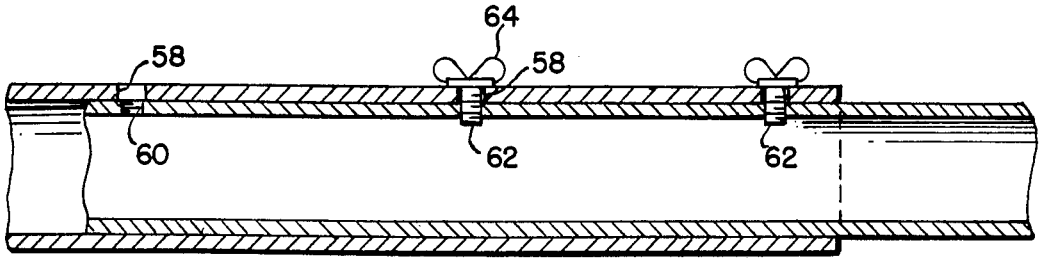

FIGS. 6 and 7 are views as seen generally from lines 6—6 and 7—7 in FIG. 5; and FIG. 8 is an enlarged sectional view of the connecting joint of the elongated pole of FIG. 1.

DETAILED DESCRIPTION OF ILLUSTRATED EMBODIMENTS

FIG. 2 shows an overhead support member 10, a hanger wire 12 already looped over and secured to the member 10, and a tool 14 for securing or wrapping the wire onto the member 10, as illustrated somewhat by the wrap area 16. A tension section 18 of the wire 12 extends downwardly to past the lever of the grid framework (not shown), to be looped around and then secured to the framework, in somewhat the same manner as shown around the support member 10. The ceiling (not shown) is defined by a grid framework, typically defining openings of regular shapes and/or sizes, or as needed, and one ceiling panel is supported in each opening. The tension sections 18 of all of the spaced hanger wires thus bear the weight of the ceiling, and hold it spaced below the overhead support members.

FIG. 3 shows the same support member 10, with the same wire 12 having the tension section 18 and a wrap section 20, separated from one another by a bend or hook 22 angled more than perhaps 140° but something less than a full 180°. The tension section 18 and the lower end of the wrap section 20 are originally separated by more than the width of the support member 10, to allow the wrap section to be elevated above the support member 10 and then lowered to hook onto the support member, with the two sections 18 and 20 then being on opposite sides of the support member 10 (as illustrated in FIG. 3). When the hanger wire 12 is so hooked onto the support member 10, the wrap section 20 may yet typically extend below the bottom of the support member 10 by some 6–12 inches, and may be extended somewhat in the same direction as and spaced from the tension section 18 by perhaps some 1–8 inches.

The tool 14 typically will include an elongated tubular pole 28 (see FIG. 1) and a tool head 30 formed at the upper end of the pole. A finger 32 may project laterally of the pole, having an upper edge 34 and a lower edge 36. A slot 38 is formed in the finger 32, extended downwardly from the upper edge 34 a distance of the order of perhaps between $\frac{3}{8}$ and $\frac{3}{4}$ of an inch, and may be open toward the tubular pole 28, generally aligned diametrically with the center of the pole. The slot 38 is perhaps between $\frac{1}{8}$ and $\frac{3}{8}$ of an inch wide, slightly wider than the hanger wire 12 (generally less than $\frac{1}{8}$ inch in diameter) to receive the wire with some clearance; although built-up proturberances 40 on the finger 32, in the region of the slot 38, may provide that the slot also has a length equal to and perhaps up to several times the slot width. This limits the free rotation or wobble of the wire when positioned in the slot (such as in FIG. 3), while holding the wrap section 20 stably spaced from the tool and projecting downwardly. The upper edge 34 of the finger 32 may be disposed substantially normal to the pole 28.

The tool head 30 may have a cylindrical sleeve 44 adapted to just fit over the upper end of the pole 28, and set screws 46 may be threaded into the sleeve 44 and driven against the pole, to hold the head onto the pole. The inside bore of the pole 28 is large enough to hold the tension sections 18*a* of many wires 12*a* simultaneously.

A side wall 48 may extend axially between the sleeve 44 and finger 32, but from one side of the pole only. The sleeve may have an upper edge 50 sloping crosswise to the pole and downwardly away from the upstanding side wall 48, and at a slight angle relative to being normal to the sleeve. The upper sleeve edge 50, near its high point, may line up somewhat with the lower edge 36 of the finger 32; and near its low point may still be above the end of the pole 28. The upper edges 50 and 34 respectively of the sleeve and finger, at their minimum are separated by approximately between $\frac{3}{4}$ of an inch and $1\frac{1}{2}$ inches.

A rib 52 may be formed adjacent the upper edge of the finger and side wall, extended part way out the finger from the sleeve, to reinforce the finger against bending.

In the embodiment of FIGS. 2–4, the head 30 may be formed of a unitary component, such as a casting; and may be formed of a nonmagnetic material, such as an aluminum alloy, a zinc die-casting, or a durable plastic. This provides that the finger 32, the slot 38 and protrubences 40, the sleeve 44, the upstanding side wall 48, the sloping edge 50, and rib 52 each may be integrally formed thereon.

The pole 28 may be formed of two telescoping tubular members 54 and 56 (see FIG. 8), the tool head 30 being secured to the smaller (inner) member 54 at its upper end and thus being spaced above the larger (outer) member 56. Means may secure the tubular members 54 and 56 together at different pole lengths. Such securing means is illustrated as a series of equally spaced holes 58 and 60 disposed along the lengths of the members, where two or possibly even three screws 62 may be fitted through adjacent holes 58 in the outer tube 56 and threaded into corresponding holes 60 in the inner tube 56. For convenience, wings 64 may be formed on the screws 62 to allow finger tightening of the screws, but yet with sufficient tightness to hold the tubes 54 and 56 securely relative to one another.

A handle 66 may be located on the outer tube 56, at its lower end, to provide a larger gripping region for the user to hold onto, for turning the pole 28 with a large torque while yet reducing the required manual gripping and turning forces, compared to the same tube without the handle.

A magnet 70 may be bonded to the side wall 48 adjacent the slot 38, being notched out to fit around the lower end and sides of the slot, operable then to magneticly attract the steel hanger wire 12 hooked over the finger 32 and carried in the slot. The magnet 70 need provide only a slight force sufficient to stabilize the hanger wire, or limit its wobble while on the tool; while allow the intentional separation of the wire from the tool. The magnet 70 may be a ferromagnetic material, such as bariun ferrite crystals, blended into a rubber or vinyl binder, and thus flexible and durable.

The side wall 48 opposite from the projection of the finger 32, is preferably angled to a narrower profile at the upper corner edge 72 (FIG. 2); thereby allowing for the tool 14 to be turned about its axis to wrap the wire, without the depending wrap section 20 accidentially hitting and hanging up on this corner edge 72 before the finger 32 hits and thus begins to wrap the wrap section.

The finger 32 may extend tangentially of the pole 28, laterally extended as a first straight portion 74 a distance of possibly between 1½ of an inch and 3 inches; and may then be bent forwardly at corner 76 toward the center of the pole and extended as a second straight portion 78 laterally a distance of possibly between 1½ of an inch and 3 inches; and then further may be bent forwardly at corner 80 even more toward the center of the pole and extended as a third straight portion 82 a short distance of perhaps an inch, being sharply transverse to or possibly even normal to the pole and spaced laterally therefrom. This curved or concave shape of the finger 32 serves to catch the wrap section 20 of the wire 12 and minimize the possibility of it sliding radially out beyond the reach of the finger 32.

A notch 84 may be formed in the lower edge 36 of the finger, adjacent the side wall 48, operable to hold the wrap section 20 of the wire 12 as the finger 32 is being turned to wrap the wire.

An alternate embodiment is also illustrated in FIGS. 5–7, where means are provided to adjust the length of the finger 132. Thus, the finger 132 may be comprised of a stationary U-shaped channel component 135 (see FIG. 7) projected off of the upstanding side wall 148, a slide component 137 guided by the stationary component 135, and tightening screw means 139 to clamp the components together. The screw of each screw means 139 may be guided in a slot 141 in the slide component 137 to allow variable overlap of the components; may have its head rounded relative to the slide component 137 to keep the inner face 143 of the finger 132 substantially smooth; and may have a square shank nonrotatably keyed in the slot 141 to allow tightening of the nut 175 of the screw means 139 without having the screw turn.

The head 130 may be formed of a steel stamping, having planar side wings 151, formed off of the lower end of the side wall 148, that may be curved to a circular shape and welded along seam 153 to define the sleeve 144. Upper and lower flanges 161 and 163 on the stationary component 135 may be folded loosely against the corresponding edges of the sliding component 137 to stablize and strengthen them.

The slot 138 may be defined, on one face, in part by the side wall 148 and by a magnet 170 bonded to the side wall 148; and on the other face, by tab 171 folded out of the side wall 148 in the region of the slot. The finger 132 may have similar straight portions 174, 178 and 182. The width and length of the slot 138 may have the same relative proportion as noted in the first emodiment, and the upper edge 150 of the sleeve 144 may be inclined; whereby the cooperation of any wire against the sides of the elongated slot 138 limits free rotation or wobble of the wire in the slot, while holding the wrap section of the wire spaced from the tool and depended downwardly, and the extra wires carried in the tool are bunched together and out of the way.

SUMMARY OF THE OPERATION

The tool 14 is used by first adjusting the length of the pole 28 as required for the user to reach the overlying support member, and also by pre-bending the hanger wires to provide the tension section 18 and wrap section 20 separated by the hook or bend 22. The tension section 18 of each hanger wire 12 will be long enough to extend between and past the support members 10 and the grid ceiling framework (not shown), typically some 3–6 feet but possibly up to 12–15 feet; and the wrap section will typically be only a foot long or slightly longer. The tension sections of the wires all fit in the open upper end of the pole, within the sleeve, and the bends hang over the upper sloping edge 50 of the sleeve. With the usual somewhat vertical orientation of the pole 28 during use, the wires all bunch up at the lower part of the sleeve edge 50, with their wrap sections facing remotely away from the upstanding side wall 48.

One wire 12 may then be pulled from this group and rotated about a half turn to swing the wrap section over the sloped corner edge 72 in order to fit the hook into the slot 38. The wire will be stably held in the elongated slot 38, with the wire butting against the slot sides, to minimiize wobble or rotation. The magnet 70 provides even greater stability by magnetically attracting and holding the wire. The wrap section 20 of the one wire is thereby isolated from all of the other wrap sections, and stably projects downwardly spaced from its tension section 18 and the tool, to allow it then to be easily hooked over the support member 10, by proper remote manipulation of the tool.

After the wire is hooked onto the support member (see FIG. 3), the tool may then be lowered to bring the finger just below the lower edge of the support member; and the tool may then be rotated in the direction to sweep the concave side of the finger against the wrap section 20 of the hooked wire 12 (clockwise as seen in FIG. 4), and whereupon continued rotation of the tool wraps the wrap section around the tension section of the wire. Building code requirements in many jurisdictions require that three complete turns of the wire be made at the wrap 16; and this may be done merely by turning the tool this many times. When the tool is being rotated, the wrap section 20 may tend to slide along against the lower edge 36 of the finger and seat against the upstanding wall 48 (or in the notch 84); and the tension section of the wire below the region of the wrap 16 is loosely held within the pole tube, and does not become entwined with the tool. After the wrap 16 has been completed, the tool 14 may be lowered further, pulling the tension section 18 of the wrapped wire out the upper end of the pole.

After each hanger wire has been secured to the overlying support member 10, it may be necessary to grip the lower part of the tension section 18 of each and snap it tightly, to remove any slack in the wire particularly as formed in the loop around the support member. When the grid framework (not shown) of the suspended ceiling is then secured to the lower end of the tension sections, its height can be adjusted accurately; and the ceiling will not sag even when its full weight is supported on the hanger wires.

What is claimed as our invention is:

1. A tool for positioning and wrapping a hanger wire, having tension and wrap sections connected together across a bend section, onto and to an overhead support member, initially with the bend section overlying the support member and the tension and wrap sections then being on opposite sides of the support member and spaced apart and each extended below the support member, and then with a wrap configuration underlying the support member, the combination comprising an elongated member;

means extending axially upward beyond one end of the elongated member, along one side thereof;

a slot open downwardly from an upper edge of the axially extending means and extended radially of the elongated member, said slot having a width sized to loosely receive the bend section on one hanger wire, and having a length extended radially of the elongated member, a distance less than the separation between the tension and wrap sections but sufficient to restrict wobble of the hanger wire as supported therein;

a finger supported off the axially extended means and projected laterally of the elongated member and the radial direction of the slot, said finger being extended from the elongated member a distance greater than the separation between the tension and wrap sections, the tension section of a first hanger wire being received in the elongated member and the bend section than being received in the slot, to stably support the wrap section spaced from the tool in a position to be hooked over the support member, upon downward movement of the tool, whereby upon rotation of the tool about the elongated member, the finger catches the wrap section under the support member and bends it over and wraps it around the tension section, to define the wrap configuration, and the tension section of the first hanger wire then being withdrawn from the elongated member from the upper end thereof.

2. A hanger wire positioning and wrapping tool according to claim 1, wherein means below the upper end of the axially extending means defines an edge sloping crosswise to the elongated member and downwardly away from the axially extending means, at a slight angle relative to being normal to the elongaged member, the tension section of at least a second hanger wire being adapted to be simultaneously received in the elongated member with the bend section thereupon overlying the sloping edge and being biased by gravity downwardly away from the axially extending means, with the wrap section of said second hanger wire thereby projecting away from the tool in an opposite direction from the direction the wrap section ofsaid first hanger wire is projected, while said first hanger wire is yet received in the slot.

3. A hanger wire positioning and wrapping tool according to claim 2, wherein the finger has a lower edge spaced from and below the lower end of said slot, and wherein said sloping edge, at the axially extending means, lines up generally with the lower finger edge.

4. A hanger wire positioning and wrapping tool according to claim 2, further ihcluding a head having a cylindrical sleeve adapted to fit over the upper end of a pole, and means adapted to hold the head onto the pole; the axially extending means with the slot, the finger, and the means defining the sloping edge, each being formed as a unitary part of the head.

5. A hanger wire positioning and wrapping tool according to claim 4, wherein the finger has an upper edge substantially aligned with the upper edge of the axially extending means, and wherein the upper edges of the finger and of the sleeve are separated by between $\frac{3}{4}$ of an inch and $1\frac{1}{2}$ inches.

6. A hanger wire positioning and wrapping tool according to claim 1, wherein means on the axially extending means, in the region of the slot, operate to provide an elongated slot of a radial length significantly longer than the cross demension of the hanger wire, operable with the bend section in the slot then being extended radially from the tool to hold the wrap section in a stable position spaced from the finger and the axially extending means, to be easily hooked over the support member, upon the downward movement of the tool.

7. A hanger wire positioning and wrapping tool according to claim 6, wherein the slot extends downwardly from the upper edge of the axially extending means a distance of the order of between $\frac{3}{8}$ and $\frac{3}{4}$ of an inch.

8. A hanger wire positioning and wrapping tool according to claim 6, wherein means below the upper end of the axially extending means defines an edge sloping crosswise to the elongagted member and downwardly away from the axially extending means, at a slight angle relative to being normal to the elongated member, the tension section of at least a second hanger wire being adapted to be simultaneously received in the elongated member with the bend section thereupon overlying the sloping edge and being biased by gravity downwardly away from the axially extending means, with the wrap section of said second hanger wire thereby projecting away from the tool in an opposite direction from the direction the wrap section of said first hanger wire is projected, while said first hanger wire is yet received in the slot.

9. A hanger wire positioning and wrapping tool according to claim 8, wherein the finger has a lower edge spaced from and below said upper finger edge, and wherein said sloping edge, at the axially extending means, lines up generally with the lower finger edge.

10. A hanger wire positioning and wrapping tool according to claim 9, wherein the axially extending means has an upper corner edge disposed remotely of the projection of the finger away from the elongated member, said upper corner edge being laterally spaced from the elongated member a distance much less than the separation of tension and wrap section, and the upper corner edge also being tapered, being laterally closer to the wall slot at the upper wall edge than from the wall slot below the upper wall edge, to allow rotation of the tool with the tension section of the first hanger wire being within the elongated member and with the wrap section being adjacent but spaded with clearance from the upper corner edge.

11. A hanger wire positioning and wrapping tool according to claim 10, wherein the finger has a first portion extended tangentially of the elongated member, and a second portion extended off of the end of the first portion remote from the elongated member, and being angled slightly therefrom in the direction toward the center of the elongated member.

12. A hanger wire positioning and wrapping tool according to claim 11, wherein the finger has yet a third portion extended off of the second portion and angled slightly therefrom in the direction toward the center of the elongated member, and being substantially normal to the center of the elongated member.

13. A hanger wire positioning and wrapping tool according to claim 1, wherein the finger has a first portion extended tangentially of the elongated member, and a second portion extended off of the end of the first portion remote from the elongated member, and being angled slightly therefrom in the direction toward the center of the elongated member.

14. A tool for positioning and wrapping a hanger wire, having tension and wrap sections connected together across a bend section, onto and to an overhead support member, initially with the bend section overlying the support member and the tension and wrap sections then being on opposite sides of the support member and spaced apart and each extended below the support member, and then with a wrap configuration underlying the support member, the combination comprising a unitary head having a sleeve, an axial wall upstanding from the sleeve, and a finger projecting laterally away from the wall and sleeve;

said wall extending axially upward beyond the upper end of the sleeve, along one side thereof;

said sleeve being sized to receive the tension sections of many hanger wires simultaneously, and means associated with said sleeve to generally bunch such wire hangers together as received therein and to provide that the wrap sections of said bunched wire hangers project substantially radially away from the sleeve in a direction therefrom opposite from wall;

said wall having an upper edge and guide means open downwardly from the upper wall edge generally overlying the sleeve, but being spaced axially above the sleeve;

said guide means extending radially of the sleeve, and having a width sized to receive the bends section of one hanger wire and having a length extended several times the width, but terminating radially spaced from the sleeve a distance less than the separation between the tension and wrap sections;

said finger being supported off the wall and projecting laterally of the sleeve and the radial direction of the guide means, a distance greater than the separation between the tension and wrap sections;

whereby in use, the tension sections of several wire hangers may be received simultaneously in the sleeve, with the wrap sections of said wire hangers then projecting substantially radially away from the sleeve in one direction; and the bend section of a first wire hanger may then be positioned in the guide means, with its wrap section then supported spaced from the sleeve and finger and in a position suited to be hooked over the support member, upon downward movement of the tool, and upon rotation of the tool about the sleeve, the finger may catch the wrap section of the first hanger wire and bend it over and wrap it around the tension section of the first hanger wire, at a location underlying the support member, and the first hanger wire tension section may then be withdrawn from the sleeve from the upper end thereof.

15. A hanger wire positioning and wrapping tool according to claim 14, wherein said means associated with the sleeve includes an edge sloping crosswise to the sleeve and downwardly away from the guide means, at a slight angle relative to being normal to the sleeve, the tension sections of said many hanger wires being adapted to be simultaneously received in the sleeve width the bend sections thereof overlying the sloping edge and being biased by gravity downwardly away from the wall, and the wrap sections of saidmany hanger wires thereby being projected away from the sleeve in a direction opposite the direction the wrap section of said first hanger wire is projected from the sleeve, while said first hanger wire is yet received in the guide means.

16. A hanger wire positioning and wrapping tool according to claim 14, wherein said guide means includes a slot open downwardly from said upper edge of the wall and extended radially of the sleeve, said slot having a width sized to loosely receive the bend section of one hanger wire and having a length radially of the sleeve that is less than the separation between the tension and wrap sections, but several times the width of the slot, to stablize the hanger wire is supported therein relative to the sleeve.

17. A hanger wire positioning and wrapping tool according to claim 16, whrein said means associated with the sleeve includes an edge sloping crosswise to the sleeve and downwardly away from the guide means, at a slight angle relative to being normal to the sleeve, the tension sections of said many hanger wires being adapted to be simultaneously received in the sleeve with the bend sections thereof overlying the sloping edge and being biased by gravity downwardly away from the wall, and the wrap sections of said many hanger wires thereby being projected away from the sleeve in a direction opposite the direction the wrap section of said first hanger wire is projected from the sleeve, while said first hanger wire is yet received in the guide means.

18. A hanger wire positioning and wrapping tool according to claim 17, further including tubular pole means adapted to fit within the sleeve, and means for securing the pole means and sleeve together, said tubular pole means being sized internally to simultaneously receive the tension sections of the many hanger wires received in the sleeve.

* * * * *